US008523543B2

(12) United States Patent
St. Denis

(10) Patent No.: US 8,523,543 B2
(45) Date of Patent: Sep. 3, 2013

(54) PUMPING ASSEMBLY

(75) Inventor: Perry L. St. Denis, Lloydminster (CA)

(73) Assignee: 1238585 Alberta Ltd., Lloydminster (CA)

( * ) Notice: Subject to any disclaimer, the term of this patent is extended or adjusted under 35 U.S.C. 154(b) by 566 days.

(21) Appl. No.: 11/015,292

(22) Filed: Dec. 17, 2004

(65) Prior Publication Data

US 2005/0152791 A1 Jul. 14, 2005

(30) Foreign Application Priority Data

Dec. 18, 2003 (CA) ..... 2451918

(51) Int. Cl.
*F04B 9/105* (2006.01)
*F04B 47/04* (2006.01)

(52) U.S. Cl.
USPC ..... 417/904; 417/375; 166/68.5; 166/72

(58) Field of Classification Search
USPC ..... 417/375, 415, 555.1, 904, 398; 166/68.5, 166/72; 60/372
See application file for complete search history.

(56) References Cited

U.S. PATENT DOCUMENTS 1,793,793 A * 2/1931 Granger ..... 417/260
2,540,347 A * 2/1951 Pounds ..... 60/370
2,612,142 A * 9/1952 Smith ..... 91/347
2,699,154 A * 1/1955 Smith ..... 91/311
3,212,406 A * 10/1965 McDuffie ..... 417/904
4,187,765 A * 2/1980 Mattoon ..... 92/13.1
4,305,461 A * 12/1981 Meyer ..... 166/77.4
4,646,517 A * 3/1987 Wright ..... 60/371
5,832,727 A * 11/1998 Stanley ..... 60/372

FOREIGN PATENT DOCUMENTS

CA 2403439 1/2003
RU 2 133 875 C1 7/1999

OTHER PUBLICATIONS

Office Action mailed May 5, 2011, from U.S. Appl. No. 11/997,140, filed Aug. 6, 2008, 5 pages.

* cited by examiner

*Primary Examiner* — Peter J Bertheaud
(74) *Attorney, Agent, or Firm* — Eubanks PLLC

(57) ABSTRACT

A pumping assembly includes a well head with a radial flow channel for pumped fluids. A spacer stand is secured to the well head. A hydraulic pump is provided with a housing secured to the spacer stand. The hydraulic pump has a hydraulic ram tied to a reciprocating annular piston having a central bore. When the annular piston moves in an upward direction the hydraulic ram moves toward an extended position extending from the housing. When the annular piston moves in a downward direction, the hydraulic ram moves toward a retracted position retracted within the housing. A polish rod extends up through the central bore of the annular piston and is held in position by a polish rod clamp positioned on top of the hydraulic ram. The polish rod moves with the hydraulic ram.

2 Claims, 3 Drawing Sheets

PUMPING ASSEMBLY

FIELD OF THE INVENTION

The present invention relates to a pumping assembly, for pumping liquids from a well.

BACKGROUND OF THE INVENTION

Canadian Patent 2,403,439 describes a method of pumping liquids from a well using a tubing string. Problems have been experience in the field with installations using this method. With the method, pumped fluids passed through the tubing string and out through the top of the pump. A hose attachment was required to direct the pumped fluids to appropriate storage. Repeated movement of the tubing string served to fatigue the hose, requiring frequent servicing. Under some pumping conditions, this pumping action would dislodge the tubing anchor.

SUMMARY OF THE INVENTION

The present invention relates to a pumping assembly which overcomes the disadvantages of the above described method.

According to the present invention there is provided a pumping assembly, which includes a well head with a radial flow channel for pumped fluids. A spacer stand is secured to the well head. A hydraulic pump is provided with a housing secured to the spacer stand. The hydraulic pump has a hydraulic ram tied to a reciprocating annular piston having a central bore. When the annular piston moves in an upward direction the hydraulic ram moves toward an extended position extending from the housing. When the annular piston moves in a downward direction, the hydraulic ram moves toward a retracted position retracted within the housing. A polish rod extends up through the central bore of the annular piston and is held in position by a polish rod clamp positioned on top of the hydraulic ram. The polish rod moves with the hydraulic ram. A stuffing box is positioned within the spacer stand and engages the polish rod to prevent pumped fluids from bypassing the radial flow channel by passing along the polish rod and through the central bore of the annular piston.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
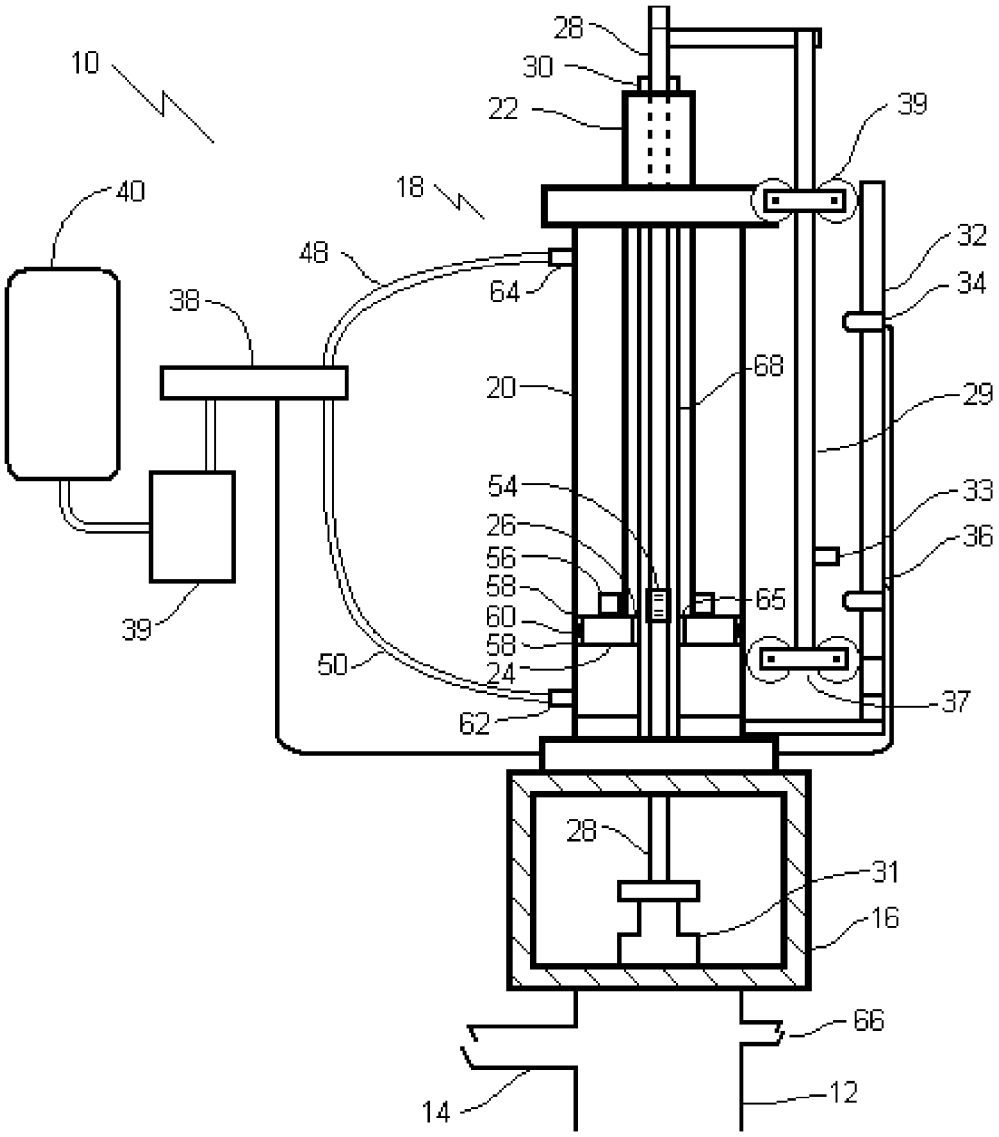
FIG. 1 is a side elevation view, in section, of a pumping assembly constructed in accordance with the teachings of the present invention, with the hydraulic ram in an extended position.

The preferred embodiment, a pumping assembly generally identified by reference numeral 10, will now be described with reference to FIGS. 1 and 2.

Structure:

Referring to FIG. 1, there is shown a pumping assembly 10 comprised of a well head 12 with a radial flow channel 14 for pumped fluids, a spacer stand 16 secured to the well head 12, and a hydraulic pump 18 with a housing 20 secured to the spacer stand 16. The hydraulic pump 18 has a hydraulic ram 22 tied to a reciprocating annular piston 24 that has a central bore 26, such that when the annular piston 24 moves in an upward direction, the hydraulic ram 22 moves toward an extended position extending from the housing 20, when the annular piston 24 moves in a downward direction, the hydraulic ram 22 moves toward a retracted position refracted within the housing 20. There is also a polish rod 28 extending up through the central bore 26 of the annular piston 24 and held in position by a polish rod clamp 30 positioned on top of the hydraulic ram 22, such that the polish rod 28 moves with the hydraulic ram 22. Within the housing 20, the polish rod 28 is also surrounded by a secondary tube 68 as well as the hydraulic ram 22. At the bottom of the hydraulic ram 22 are located seals 65. On the bottom of the housing 20 and around the hydraulic ram 22 are located bearings 60, bearing seal 58, and a stop block 56. Stop block 56 moves with ram 22, and ensures that ram 22 does not extend too far up or down in the event of an equipment malfunction. Rod coupling 54 is used attach two rods together to simplify installation. There is also a stuffing box 31 positioned within the spacer stand 16 and engaging the polish rod 28 to prevent pumped fluids from bypassing the radial flow channel 14 by passing along the polish rod 28 and through the central bore 26 of the annular piston 24.

Figure 3:
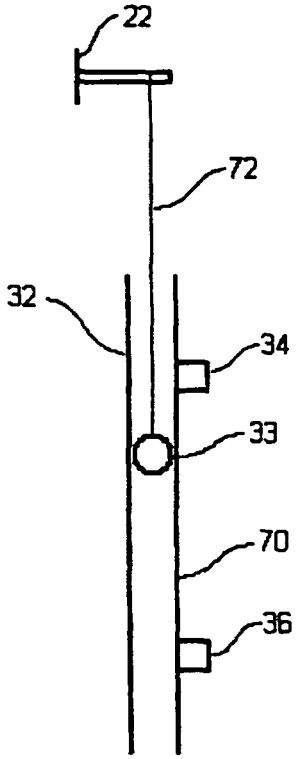
FIG. 3 is an alternate view of an external guide.

Another feature of the invention is an external guide 32 that is provided on the hydraulic pump 18. The external guide 32 is stationary and has an upper proximity switch 34 and a lower proximity switch 36 tied to control valves 38 and a source of hydraulic fluid 40. A moving guide 29 is attached to hydraulic ram 22 or another part that moves with hydraulic ram 22 such as polish rod 28. Moving guide 29 has a piece of metal 33 attached to it such that, as it approaches the proximity switch 36, the switch 36 is triggered, causing the ram 22 to extend. As piece of metal 33 approaches proximity switch 34, the switch 34 is triggered and the ram 22 begins to retract. The moving guide 29 is guided by wheels 37 which move with the moving guide 29, and wheels 41 which are attached to the stationary guide 32 and the housing 20. Referring to FIG. 3, the external guide 32 comprises a tube 70 of non-conducting piping such as PVC piping. Proximity switches 34 and 36 are attached directly to the outside of piping 70. Piece of metal 33 is attached to wire 72 which moves up and down with ram 22. The operation of the switches proceeds as before.

Figure 2:
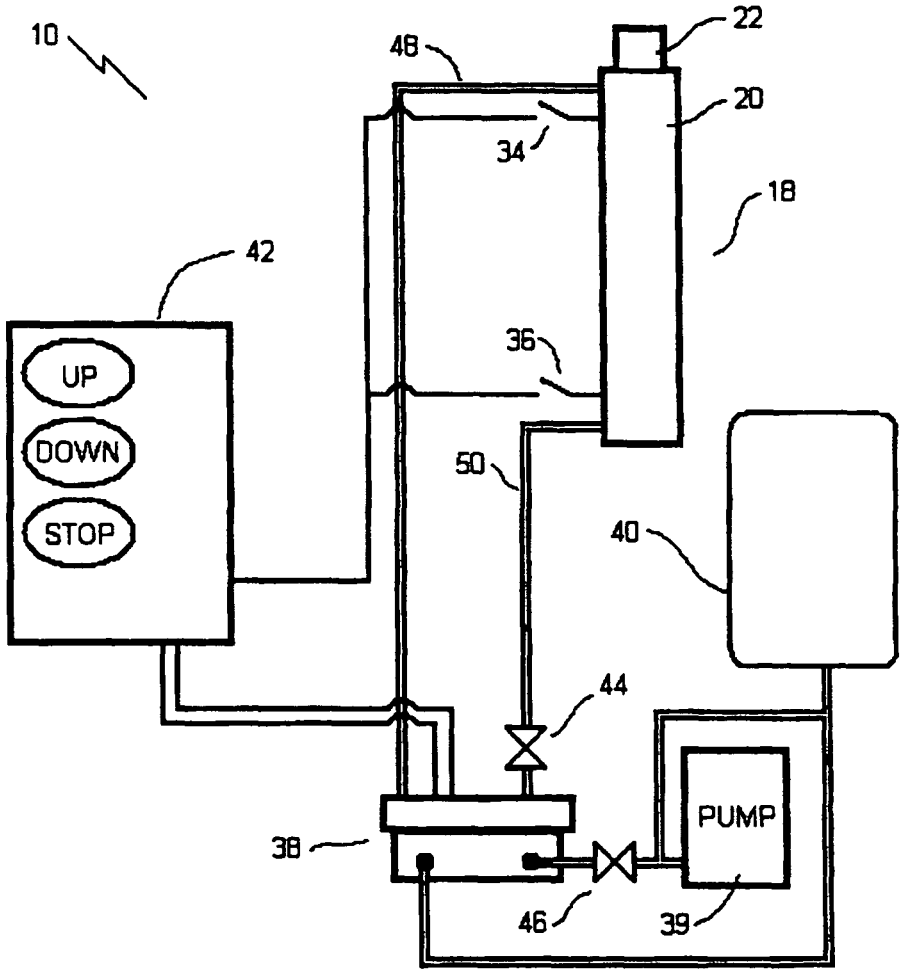
FIG. 2 is a block diagram of a pumping assembly constructed in accordance with the teachings of the present invention, with the hydraulic ram in a retracted position.

Referring to FIG. 2, the proximity switches 34 and 36 may also be tied to a control panel 42 that also includes override buttons such as up, down, or stop for manual control of the hydraulic pump. When the upper proximity switch 24 is triggered, hydraulic fluid is pumped from the source of hydraulic fluid 40 by pump 39 via the control valves 38 through line 48 into the hydraulic pump 18 from above the annular piston 24 to urge the annular piston 24 in the downward direction. When the lower proximity switch 36 is triggered, hydraulic fluid is pumped from the source of hydraulic fluid 40 by pump 39 via the control valves 38 through line 50 into the hydraulic pump 18 from below the annular piston 24 to urge the annular piston 24 in the upward direction. Referring to FIG. 1, the hydraulic fluid is pumped into the hydraulic pump through hydraulic input 62 on the bottom and hydraulic input 64 on the top.

Operation:

Referring to FIG. 1, liquids are pumped from a well through well head 12 and through a radial flow channel 14 by using a pumping assembly 10. There may also be a sample test cock 66 on the well head 12 for obtaining samples. The liquid is pumped from the well using a hydraulic pump 18. Hydraulic pump 18 includes a piston 24 with a hydraulic ram 22 and a polish rod 28 inside the hydraulic ram 22. The liquid is pumped as the hydraulic ram 22 is pushed up and down. The up and down movement is controlled by hydraulic fluid pumped through control valves 38 into either the hydraulic input 64 on top of the hydraulic pump 18 or into the hydraulic input 62 on the bottom of the hydraulic pump 18. As the hydraulic ram moves up and down, proximity switches 34 and 36 on external guide 32 are triggered by piece of metal 33, sending signals to the control valves 38 to change the direction. When the upper proximity switch 24 is triggered, hydraulic fluid is pumped from the source of hydraulic fluid 40 by pump 39 via the control valves 38 through line 48 into the hydraulic pump 18 from above the annular piston 24 to urge the annular piston 24 in the downward direction. When the lower proximity switch 36 is triggered, hydraulic fluid is pumped from the source of hydraulic fluid 40 by pump 39 via the control valves 38 through line 50 into the hydraulic pump 18 from below the annular piston 24 to urge the annular piston 24 in the upward direction.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A pumping assembly, comprising:

a well head with a radial flow channel for pumped fluids;

a spacer stand secured to the well head;

a hydraulic pump with a housing secured to the spacer stand, the hydraulic pump having a hydraulic ram tied to a reciprocating annular piston having a central bore, the housing including a single hydraulic chamber, the annular piston directly engaging an inner surface of the housing and having a single piston head that divides the hydraulic chamber into first and second subchambers, the hydraulic pump alternatingly applying hydraulic fluid pressure directly to a bottom of the piston head of the annular piston via the first subchamber and directly to a top of the piston head of the annular piston via the second subchamber to drive the annular piston in a continuously reciprocating motion such that when the annular piston moves in an upward direction the hydraulic ram moves toward an extended position extending from the housing, and when the annular piston moves in a downward direction, the hydraulic ram moves toward a retracted position retracted within the housing;

a polish rod extending up through the central bore of the annular piston and held in position by a polish rod clamp positioned on top of the hydraulic ram, such that the polish rod moves with the hydraulic ram and such that the annular piston drives the polish rod in a continuously reciprocating motion;

a stuffing box positioned within the spacer stand and engaging the polish rod to prevent pumped fluids from bypassing the radial flow channel by passing along the polish rod and through the central bore of the annular piston; and a secondary tube separating the polish rod and the hydraulic ram, the secondary tube immediately surrounding the polish rod and having an outer surface directly engaged by the annular piston, the secondary tube being stationary relative to the housing.

2. The pumping assembly of claim 1, further comprising an external guide on the hydraulic pump, the external guide having an upper proximity switch and a lower proximity switch tied to control valves and a source of hydraulic fluid, such that upon the upper proximity switch being triggered, hydraulic fluid is pumped from the source of hydraulic fluid via the control valves into the hydraulic pump from above the annular piston to urge the annular piston in the downward direction and upon the lower proximity switch being triggered, hydraulic fluid is pumped from the source of hydraulic fluid via the control valves into the hydraulic pump from below the annular piston to urge the annular piston in the upward direction.

* * * * *